US005086442A

United States Patent [19]

Gemmel et al.

[11] Patent Number: 5,086,442

[45] Date of Patent: Feb. 4, 1992

[54] MAGNETIC COUPLING FOR A ROTATING X-RAY TUBE

[75] Inventors: Edwin Gemmel; Josef Rohmfeld, both of Erlangen; Stefan Hock, Hanau, all of Fed. Rep. of Germany

[73] Assignee: Siemens Aktiengesellschaft, Munich, Fed. Rep. of Germany

[21] Appl. No.: 675,273

[22] Filed: Mar. 26, 1991

[30] Foreign Application Priority Data

Mar. 28, 1990 [EP] European Pat. Off. ..... 90105937.8

[51] Int. Cl.[5] ..... H01J 35/10

[52] U.S. Cl. ..... 378/132; 378/125; 310/154

[58] Field of Search ..... 378/125-136, 378/132, 131, 144; 310/181, 154

[56] References Cited

U.S. PATENT DOCUMENTS

| | | | |
|---|---|---|---|
| 2,311,724 | 2/1943 | Atlee | 378/131 |
| 3,710,162 | 1/1973 | Bougle | 378/131 |
| 3,984,711 | 10/1976 | Kordik | 310/181 |
| 4,468,801 | 8/1984 | Sudo et al. | 378/132 |

FOREIGN PATENT DOCUMENTS 0330336 8/1989 European Pat. Off. .

OTHER PUBLICATIONS

Von Kurt Dietz "Altes und Neues Uber Röntgen-Röhren", *Röntgenpraxis,* S. Hirzel Verlag Stuttgart, 1964, pp. 31-32.

*Primary Examiner*—Janice A. Howell
*Assistant Examiner*—Don Wong
*Attorney, Agent, or Firm*—Hall, Van Santen, Steadman & Simpson

[57] ABSTRACT

A magnetic coupling for a device, such as a cathode, which is received in a vacuum bulb of a tube which has shafts for mounting the tube for rotation on an axis, has an inner ferromagnetic part disposed in the vacuum bulb and connected to the device and an outer ferromagnetic part which is arranged outside of the vacuum bulb and aligned with the inner part. The outer part comprises a magnetic arrangement having a plurality of pole pieces to which the poles of a ferromagnetic yoke that forms the inner part are allocated.

15 Claims, 2 Drawing Sheets

MAGNETIC COUPLING FOR A ROTATING X-RAY TUBE

BACKGROUND OF THE INVENTION

The present invention is directed to a magnetic coupling for a device located inside a vacuum bulb of a tube which is mounted by shafts for rotation along an axis and has an outer ferromagnetic part and an inner ferromagnetic part mounted for rotation in the vacuum bulb. Such a magnetic coupling can serve the purpose of locking a cathode arrangement of a rotating X-ray tube.

A magnetic coupling is described by Von Kurt Dietz "Altes und Neues über Röntgen-Röhren", *Röntgenpraxis*, S. Hirzel Verlag Stuttgart, 1964, pp. 31–32. A cathode arrangement in the interior of the vacuum housing is attached to a shaft extension of a rotatably mounted X-ray tube, which is referred to as a rotating X-ray tube. This cathode arrangement is likewise rotatably mounted within the tube. The cathode arrangement can be magnetically restrained by a device which is attached to the cathode arrangement. This device is composed of an inner part secured to the cathode device and of an outer part that embraces the rotating tube in the region of the inner part. The magnets are usually employed for these purposes.

What has proven disadvantageous is that during the heating and baking of the vacuum tube, the vacuum tube must be brought to a temperature which lies above the Curie point of a permanent magnet or that can at least have a partially demagnetizing effect thereon. Since the introduction of the magnetic field into the proximity of the cathode can produce undesirable deflection of the electron beam emanating from the cathode, this type of arrangement also causes problems.

SUMMARY OF THE INVENTION

An object of the present invention is to create a magnetic coupling of the above-known type that enables an optimally rigid coupling of the device and has few problems when integrated into a vacuum tube and whose magnetic field has only a slight influence on the device which is being held by the coupling.

To obtain these objects, the present invention is directed to an improvement in a magnetic coupling for a device inside a vacuum bulb which is mounted for rotation via shafts, said device having an outer ferromagnetic part and an inner ferromagnetic part rotatably mounted in the vacuum bulb. The improvements are that the outer part comprises a magnetic arrangement having a plurality of pole pieces to which the poles of a ferromagnetic yoke, which is formed by the inner part, are allocated, said ferromagnetic yoke being connected to the device. A nearly rigid coupling of the two parts is achieved with this magnetic arrangement. Since only one ferromagnetic material is used in the bulb, this can be heated or baked at a higher temperature than the Curie points of the permanent magnets.

When the pole pieces of the outer part are composed of ferromagnetic material and are connected by permanent magnets or when the pole pieces are composed of permanent magnets, this has proven advantageous. Permanent magnets composed of NdFeB, which are sold under the trademark "Vacodyn" can be especially employed as the permanent magnets. An especially strong coupling is achieved when the magnetic arrangement completely surrounds the tube and when the pole pieces are uniformly distributed over the circumference of the bulb and the yoke is fashioned with radially outwardly-extending poles.

The magnetic coupling can also be utilized in the proximity of the device when the magnetic arrangement only partially surrounds the tube. It has proven advantageous to arrange the magnetic arrangement over an arcuate segment of less than 90°, and preferably in a range of 70° to 80°. The coupling can be arranged at a great distance from the device when the shaft line close to the cathode arrangement is executed as a hollow shaft into which a second shaft connected to the device extends and when the yoke is secured to the second shaft connected to the device and when the magnetic arrangement of the magnetic coupling embraces the shaft in the region of the yoke. The magnetic coupling can be advantageously utilized in a rotating X-ray tube whereby the device is the cathode arrangement of the rotating X-ray tube.

Other advantages and features of the invention will be readily apparent from the following description of the preferred embodiments, the drawings and claims.

DESCRIPTION OF THE PREFERRED EMBODIMENTS

Figure 1:
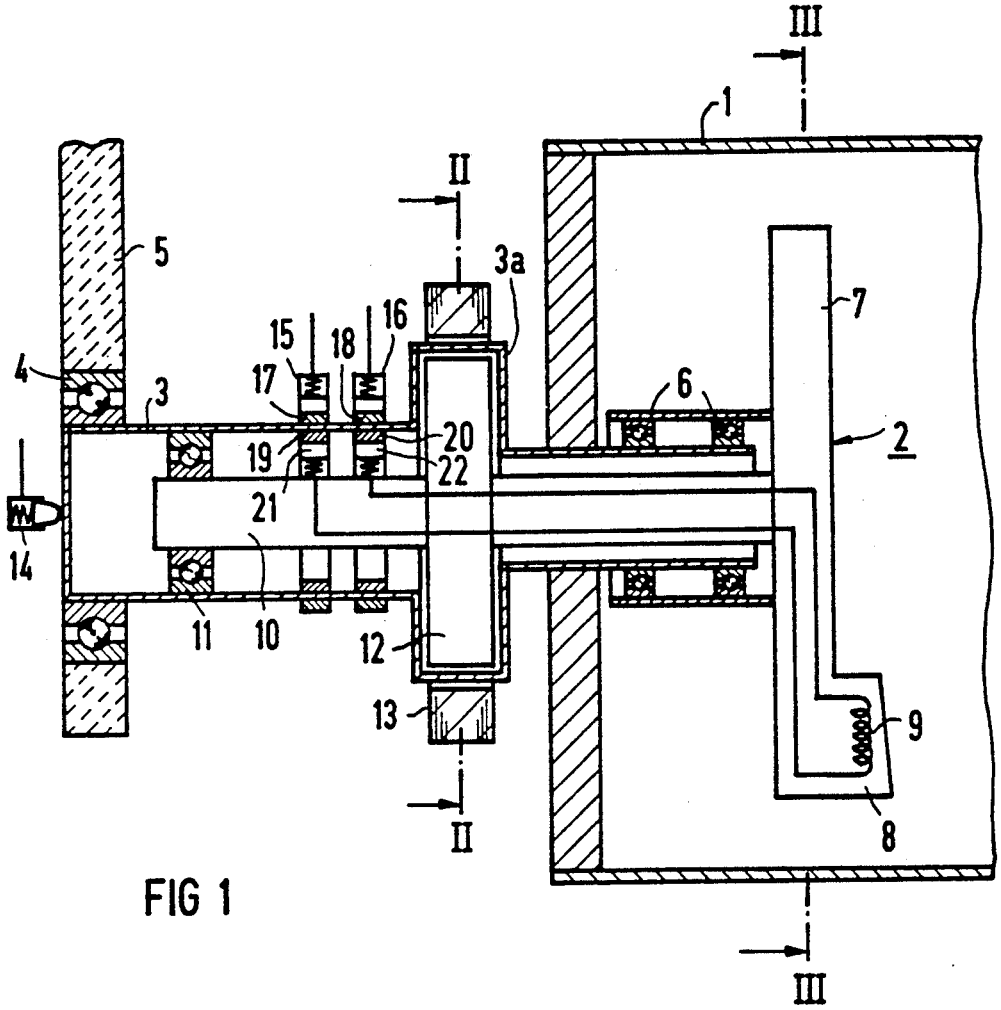
FIG. 1 is a schematic cross sectional view of a portion of a rotating X-ray tube utilizing the magnetic coupling of the present invention.

The principles of the present invention are particularly useful when incorporated into a rotating X-ray tube having a vacuum housing 1, as illustrated in FIG. 1. The rotating X-ray tube comprises an anode (not shown) connected to the vacuum housing 1 and also comprises a cathode arrangement 2 which is attached opposite the anode. The rotating X-ray tube is provided with a hollow shaft 3 that is mounted for rotation by a ball bearing 4 in a carrier 5, which is secured to the radiator housing (not shown) and which is composed of an insulating material, for example ceramics. The opposite end of the housing is also mounted by a similar shaft and, since the invention is directed to the coupling arrangement, only the cathode portion of the tube is illustrated.

The cathode arrangement 2 is mounted for rotation on the hollow shaft by ball bearings 6 and has a cathode carrier 7 on whose one end a cathode 8 is provided. The cathode 8 is provided with a heating coil 9. A shaft 10 is attached to extend on the axis of the carrier 7 into the hollow shaft 3 where a free end is supported for rotation by a ball bearing 11. The hollow shaft 3 has an enlarged portion 3*a* which will accept an armature connected to the shaft 10 or accepts a yoke 12. A magnetic arrangement 13, that is stationary and is connected to the x-radiator housing, is applied around the hollow shaft 3 in the region of the enlarged portion 3*a*.

The cathode arrangement 2 is supplied with a high-voltage occurs via a contact pin 14 that is in communication with the hollow shaft 3. The supply of the filament voltage occurs via contact pins 15 and 16 that press against wiper rings 17 and 18 that are applied on the outside of the hollow shaft 3. These wiper rings 17 and 18 are in electrical communication with inwardly disposed wiper rings 19 and 20. Additional contact pins 21 and 22, which are connected to the heater coil 9 and produce the contact, are mounted on the shaft 10 and engage the inner rings 19 and 20, respectively.

Figure 2:
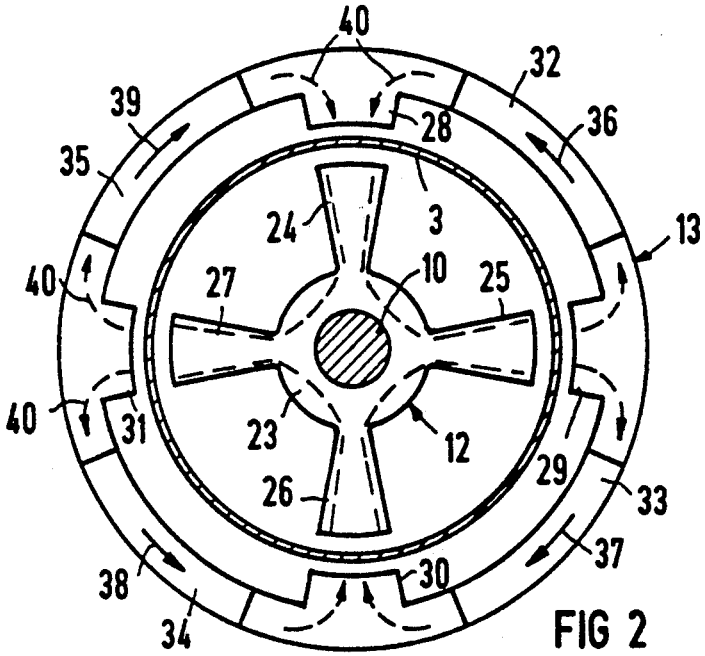
FIG. 2 is a schematic cross sectional view taken along the lines II—II of FIG. 1.

The magnetic coupling, which is formed by the yoke 12 and of the magnetic arrangement 13, is shown in greater detail in FIG. 2. The yoke 12 is composed of a ferromagnetic material and is arranged with a cross-like configuration. A middle part or hub 23 annularly surrounds the shaft 10. From this middle part 23 poles 24–27 extend radially outward. The magnetic arrangement annularly surrounds the yoke 12 and comprises pole pieces 28–31 have the same angular spacing as the poles 24–27. In the illustrated embodiment, the pole pieces 28–31 are composed of a ferromagnetic material. The pole pieces 28–31 are connected by one long permanent magnet or by a plurality of small permanent magnets 32–35, which are connected in series, wherein the respective neighboring permanent magnets 32–35 have oppositely directed magnetic polarization, as indicated by the arrows 36–39. A magnetic flux corresponding to the arrows 40 therefore extends from the poles of the permanent magnets 32–35 through the pole pieces 28–31 and through the yoke 12, as illustrated by these arrows. The hollow shaft 3 can now turn in the air gap which extends between the poles 24–27 and the pole pieces 28–31 without the yoke 12 and, thus, the cathode arrangement 2 co-rotating. As a result thereof, the cathode arrangement 2 is held nearly rigidly in its illustrated position.

Figure 3:
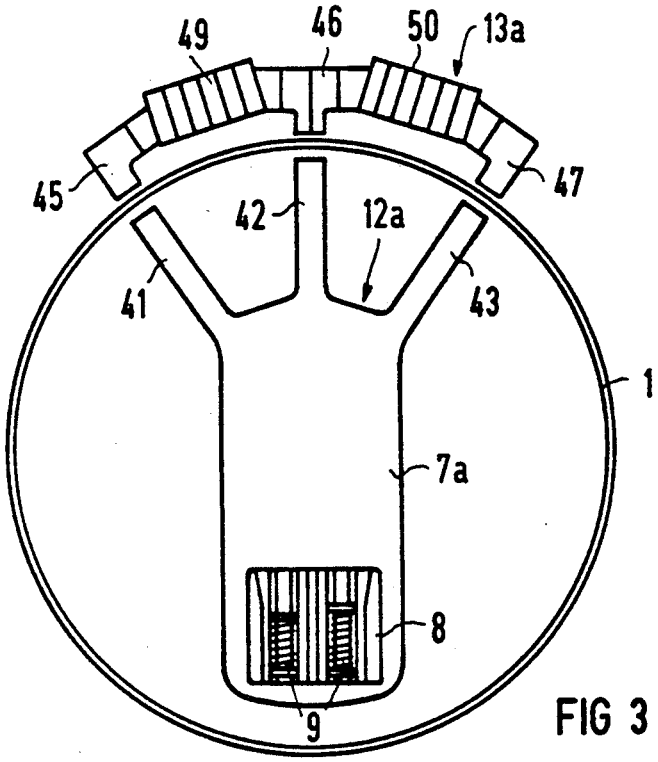
FIG. 3 is a partial view taken along the lines III—III of FIG. 1 of an embodiment of the magnetic coupling device according to the present invention.
Figure 4:
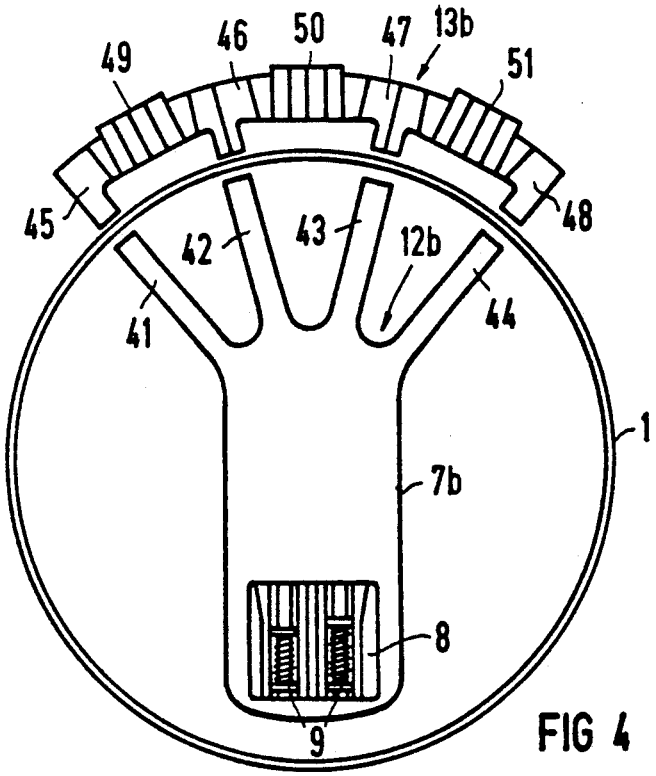
FIG. 4 is a cross sectional view similar to FIG. 3 of yet another embodiment of the magnetic coupling device of the present invention.

FIGS. 3 and 4 show two embodiments of the magnetic coupling for the cathode arrangement 2 of a rotating X-ray tube. In this case, the magnetic coupling is directly joined to the cathode carrier 7*a* of FIG. 3 or 7*b* of FIG. 4 and is positioned to lie opposite the cathode 8 thereof. A yoke 12*a* of FIG. 3 is composed of three radially outwardly extending poles 41–43, which are arranged star-like or like radially extending fingers. In a similar manner, a yoke 12*b* of FIG. 4 has four radially outwardly directed poles 41–44. In FIG. 3, the arrangement 13*a* has three pole pieces 45–47 which are allocated to the poles 41–43. In FIG. 4, an arrangement 13*b* has four pole pieces 45–48 which are arranged with the same spacing as the poles 41–44. The arrangement 13*a* has two permanent magnets 49 and 50 which are arranged between the three pole pieces 45–47, while the arrangement 13*b* has three magnets 49–51 arranged between the four pole pieces 45–48. A vacuum housing 1 is situated in the air gap between the poles 41–43 and the pole pieces 45–47 of the arrangement of FIG. 3. The hollow shaft 3 can, thus, be executed with a simpler construction, based on the specific arrangement of the magnetic coupling. As a result, the magnetic coupling arranged opposite the cathode, moreover, only a slight disturbance due to the magnetic field will occur, since the yoke 12*a* or 12*b* keeps the magnetic field lines away from the cathode 8.

Instead of fashioning the pole pieces 28–31 and 45–48 of ferromagnetic material and instead of connecting the pole pieces by permanent magnets, such as 32–45 or 49–51, respectively, the pole pieces could be composed of permanent magnet materials which could be connected by correspondingly constructed ferromagnetic material. This arrangement yields a magnetic coupling that holds the device nearly rigid in its desired position. It has a simple structure and can be unproblematically accommodated in a vacuum tube that is to be heated or baked because no permanent magnetic material needs to be within the vacuum tube itself.

Although various minor modifications may be suggested by those versed in the art, it should be understood that we wish to embody within the scope of the patent granted hereon all such modifications as reasonably and properly come within the scope of our contribution to the art.

We claim:

1. In a magnetic coupling for a device disposed in a vacuum bulb of a tube which has shafts rotatably mounted to enable rotation of the tube, said coupling comprising an inner ferromagnetic part mounted for rotation in the vacuum bulb and an outer ferromagnetic part, the improvements comprising the outer part comprising a magnetic arrangement having a plurality of pole pieces and the inner part being a ferromagnetic yoke being connected to said device, said ferromagnetic yoke having poles allocated to the pole pieces of the magnetic arrangement.

2. In a magnetic coupling according to claim 1, wherein the pole pieces of the outer part are composed of a ferromagnetic material and are joined by permanent magnets.

3. In a magnetic coupling according to claim 2, wherein the permanent magnets are composed of NdFeB.

4. In a magnetic coupling according to claim 1, wherein the pole pieces are composed of permanent magnets.

5. In a magnetic coupling according to claim 4, wherein the permanent magnets are composed of NdFeB.

6. In a magnetic coupling according to claim 1, wherein the yoke is fashioned with radially outwardly directed poles and the magnetic arrangement completely surrounds the tube and has pole pieces which are uniformly distributed along the circumference of the vacuum bulb with the spacing equal to the spacing of the poles of the yoke.

7. In a magnetic coupling according to claim 1, wherein the magnetic arrangement partially surrounds the tube.

8. In a magnetic coupling according to claim 7, wherein the magnetic arrangement is arranged to extend over an arcuate segment of an angle of less than 90°.

9. In a magnetic coupling according to claim 8, wherein the magnetic arrangement is arranged to extend over an arcuate segment of an angle in the range of 70° to 80°.

10. In a magnetic coupling according to claim 7, wherein the device is secured to one side of a carrier, whose other end forms the yoke, said poles being diverging radially like fingers.

11. In a magnetic coupling according to claim 10, wherein the tube is an X-ray tube and the device is a cathode arrangement of the X-ray tube.

12. In a magnetic coupling according to claim 1, wherein one shaft of the tube adjacent the device is a hollow shaft, said device having a second shaft extending axially therefrom through said hollow tube, the yoke being secured to said second shaft, and the magnetic arrangement of the coupling device surrounding the second shaft in the region of said yoke.

13. In a magnetic coupling according to claim 12, wherein the tube is a rotating X-ray tube and the device is a cathode arrangement of the rotating X-ray tube.

14. In a magnetic coupling according to claim 12, wherein the hollow shaft has an enlarged portion, said yoke being secured to the second shaft and extending into said enlarged portion of said hollow shaft.

15. In a magnetic coupling according to claim 1, wherein the tube is a rotation X-ray tube and the device is a cathode arrangement of the rotating X-ray tube.

* * * * *